US007564298B2

(12) United States Patent
Mun et al.

(10) Patent No.: US 7,564,298 B2
(45) Date of Patent: Jul. 21, 2009

(54) VOLTAGE REFERENCE CIRCUIT AND CURRENT REFERENCE CIRCUIT USING VERTICAL BIPOLAR JUNCTION TRANSISTOR IMPLEMENTED BY DEEP N-WELL CMOS PROCESS

(75) Inventors: Hyun-Won Mun, Yongin-si (KR); Il-Ku Nam, Anyang-si (KR); Sang-Yeob Lee, Suwon-si (KR); Min-Kyu Je, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 152 days.

(21) Appl. No.: 11/608,279

(22) Filed: Dec. 8, 2006

(65) Prior Publication Data

US 2007/0182478 A1 Aug. 9, 2007

(30) Foreign Application Priority Data

Feb. 6, 2006 (KR) ..... 10-2006-0011310

(51) Int. Cl.
*G05F 1/10* (2006.01)

(52) U.S. Cl. ..... 327/539

(58) Field of Classification Search ..... 327/539
See application file for complete search history.

(56) References Cited

U.S. PATENT DOCUMENTS 5,011,784 A * 4/1991 Ratnakumar ..... 438/203
6,489,835 B1 * 12/2002 Yu et al. ..... 327/539
6,511,889 B2 * 1/2003 Takiguchi ..... 438/331
6,529,066 B1 * 3/2003 Guenot et al. ..... 327/539
6,911,862 B2 6/2005 Marotta et al.
7,205,755 B2 * 4/2007 Ito et al. ..... 323/316

FOREIGN PATENT DOCUMENTS

KR 1020010011793 2/2001
KR 1020040006521 1/2004
KR 1020050007755 1/2005

OTHER PUBLICATIONS

Gromov, V. "Development of the Bandgap Voltage Reference Circuit, Featuring Dynamic-Threshold MOS Transistors (DTMOST's) in 0.13μm CMOS Technology.", NIKHEF, Kruislaan 409, Amsterdam, the Netherlands. May 10, 2004.

* cited by examiner

*Primary Examiner*—Lincoln Donovan
*Assistant Examiner*—William Hernandez
(74) *Attorney, Agent, or Firm*—F. Chau & Assoc., LLC

(57) ABSTRACT

A voltage reference circuit and a current reference circuit using a vertical bipolar junction transistor (BJT) implemented by a deep N-well complementary metal-oxide semiconductor (CMOS) process, wherein the voltage reference circuit generates a constant reference voltage regardless of temperature and includes an amplifier element having a positive input terminal and a negative input terminal, a first transistor, and a second transistor. The first transistor is electrically connected to the positive input terminal and the second transistor is electrically connected to the negative input terminal. Each of the first and second transistors is a vertical BJT implemented by a deep N-well CMOS process, and the reference voltage is calculated by adding a base-emitter voltage of one of the first and second transistors to a value obtained by multiplying a thermal voltage by a predetermined factor. Accordingly, circuits having better reproducibility, uniformity, and device matching than circuits that use a lateral NPN/PNP device or substrate NPN/PNP device manufactured using a CMOS process are provided.

4 Claims, 7 Drawing Sheets

VOLTAGE REFERENCE CIRCUIT AND CURRENT REFERENCE CIRCUIT USING VERTICAL BIPOLAR JUNCTION TRANSISTOR IMPLEMENTED BY DEEP N-WELL CMOS PROCESS

CROSS-REFERENCE TO RELATED APPLICATIONS

This application claims the priority of Korean Patent Application No. 10-2006-0011310, filed on Feb. 6, 2006, in the Korean Intellectual Property Office, the disclosure of which is incorporated herein in its entirety by reference.

BACKGROUND OF THE INVENTION

1. Technical Field

The present disclosure relates to a semiconductor circuit and, more particularly, to a voltage reference circuit and a current reference circuit using a vertical bipolar junction transistor (BJT) implemented by a deep N-well complementary metal-oxide semiconductor (CMOS) process.

2. Discussion of the Related Art

Generally, a bipolar junction transistor (BJT) has better junction characteristics between elements than a metal-oxide semiconductor (MOS). Meanwhile, some circuits require BJT characteristics to perform a particular function. Accordingly, it is necessary to simultaneously implement a MOS device and a BJT device in a single process. A bipolar complementary metal-oxide semiconductor (BiCMOS) process referring to the integration of a CMOS device and a BJT device into a single device, however, requires higher manufacturing costs and a longer time for development, yet provides much lower digital circuit performance than a CMOS process. In addition, when a BJT is implemented using a CMOS process, the device characteristics of the BJT also decrease.

FIGS. 1A through 2 illustrate examples of a conventional BJT device implemented by a CMOS process.

FIG. 1A is a cross-sectional view of a conventional lateral BJT implemented by a CMOS process and FIGS. 1B and 1C illustrate device symbols of a conventional lateral BJT. Referring to FIG. 1A, an N-well 11 is formed on a P substrate 10 using a CMOS process. N+ r P+ ions are implanted or diffused into each of predetermined regions in the N-well 11 and the P substrate 10 thereby forming a base region 14, a collector region 13, and an emitter region 12. An emitter terminal E and a collector terminal C are formed on the P+ regions 12 and 13, respectively, a base terminal B is formed on the N+ region 14; a substrate terminal SUB is formed on a P+ region 15; and a gate terminal G is formed at a predetermined portion on the N-well 11.

As is illustrated in FIG. 1A, a lateral PNP BJT Q1 can be obtained in a normal CMOS process. However, parasitic BJTs Q2 and Q3 are also generated during the process of obtaining the lateral PNP BJT Q1.

FIGS. 1B and 1C are symbols illustrating a lateral BJT and a parasitic BJT one with the other. Referring to FIG. 1B, a lateral BJT (Q1) is formed among an emitter E, a base B, and a collector C and also a vertical parasitic BJT (Q2 or Q3) is formed among the emitter E the base B, and a substrate SUB.

Referring to FIG. 1C, a lateral BJT (Q1) is formed among an emitter E, a base B, and a collector C and also a vertical parasitic BJT (Q2 or Q3) is formed among the emitter E, a gate G, and a substrate SUB.

As described above, due to a parasitic vertical BJT, the characteristics and particularly the current gain (β) of a lateral BJT implemented by a CMOS process decrease remarkably. In addition, the parasitic capacitance between a base that is, an N-well, and a substrate is large. In a lateral BJT implemented by a CMOS process, a base width is determined by a gate length (L) of a MOSFET. When the gate length decreases, the frequency characteristics and the current gain increase. Accordingly, the frequency characteristics and the current gain may be increased through the scale-down of the gate length. The lateral BJT, however, is degraded in reproducibility, uniformity device matching, and current drivability, whereby a circuit using this lateral BJT is eventually degraded.

FIG. 2 is a cross-sectional view of a conventional substrate BJT implemented by a CMOS process. Referring to FIG. 2, an N-well 21 is formed on a P substrate 20 formed using a CMOS process. N+ or P+ ions are implanted or diffused into each of predetermined regions in the N-well 21 and the P substrate 20, thereby forming base regions 23 and 25, collector regions 22 and 26, and an emitter region 24. As a result, the substrate BJT is obtained.

Since collectors C are stuck in the substrate 20 in the substrate BJT usually used in a bandgap circuit it is difficult to use the substrate BJT in a circuit. In addition, the N-well 21 is so thick that BJT characteristics are decreased.

As described above, a lateral BJT and a substrate BJT, which are implemented by a CMOS process, have many drawbacks. Accordingly, technology capable of replacing lateral or substrate BJTs is desired for circuits implemented by a CMOS process and needing BJT operating characteristics.

SUMMARY OF THE INVENTION

Exemplary embodiments of the present invention provide a voltage reference circuit using a vertical bipolar junction transistor (BJT) device obtained through a deep N-well complementary metal-oxide semiconductor (CMOS) process, instead of using a lateral BJT or a substrate BJT device, to overcome drawbacks of the lateral BJT device and the substrate BJT device, thereby improving circuit performance.

Exemplary embodiments of the present invention provide a current reference circuit using a vertical BJT device obtained through a deep N-well CMOS process, instead of using a lateral BJT or a substrate BJT device, to overcome drawbacks of the lateral BJT device and the substrate BJT device, thereby improving circuit performance.

According to an exemplary embodiment of the present invention, there is provided a voltage reference circuit for generating a constant reference voltage regardless of the temperature. The voltage reference circuit includes an amplifier element having a positive input terminal and a negative input terminal, a first transistor, and a second transistor. The first transistor is electrically connected to the positive input terminal and the second transistor is electrically connected to the negative input terminal. Each of the first and second transistors is a vertical BJT implemented by a deep N-well CMOS process, and the reference voltage is calculated by adding a base-emitter voltage of one of the first and second transistors to a value obtained by multiplying a thermal voltage by a predetermined factor.

According to an exemplary embodiment of the present invention, there is provided a current reference circuit for generating a reference current proportional to temperature. The current reference circuit includes an amplifier element having a positive input terminal and a negative input terminal, a first transistor, a second transistor, and an output unit. The first transistor is connected between a first node and one of the positive input terminal and the negative input terminal. The second transistor is connected between a second node and the other of the positive input terminal and the negative input terminal. The output unit outputs the reference current in response to an output voltage of the amplifier element. Each of the first and second transistors is a vertical BJT implemented by a deep N-well CMOS process, and the reference current is calculated by multiplying a thermal voltage by a predetermined factor.

BRIEF DESCRIPTION OF THE DRAWINGS

Exemplary embodiments of the present invention will be understood in more detail from the following descriptions taken in conjunction with the attached drawings in which.

DETAILED DESCRIPTION OF EXEMPLARY EMBODIMENTS

Figure 1A:
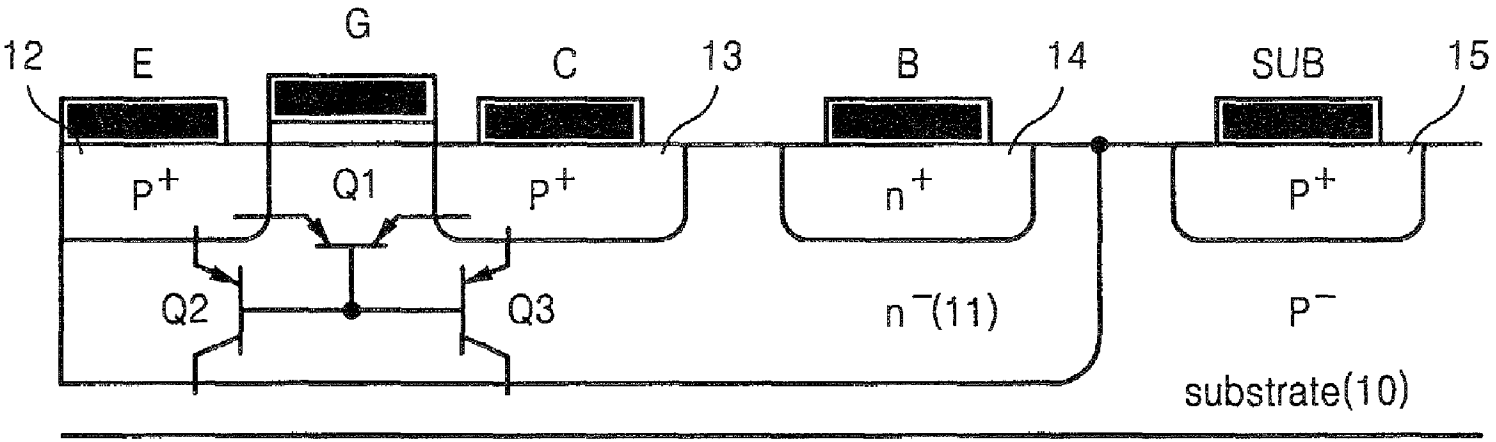
FIG. 1A (PRIOR ART)
FIGS. 1A through 2 illustrate examples of a conventional bipolar junction transistor (BJT) device implemented by a complementary metal-oxide semiconductor (CMOS) process.
Figure 1C:
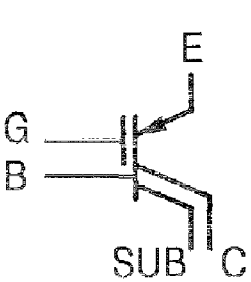
FIG. 1C (PRIOR ART)
Figure 1B:
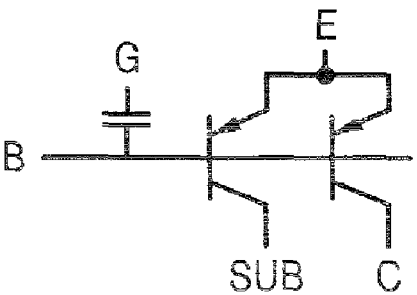
FIG. 1B (PRIOR ART)
Figure 2:
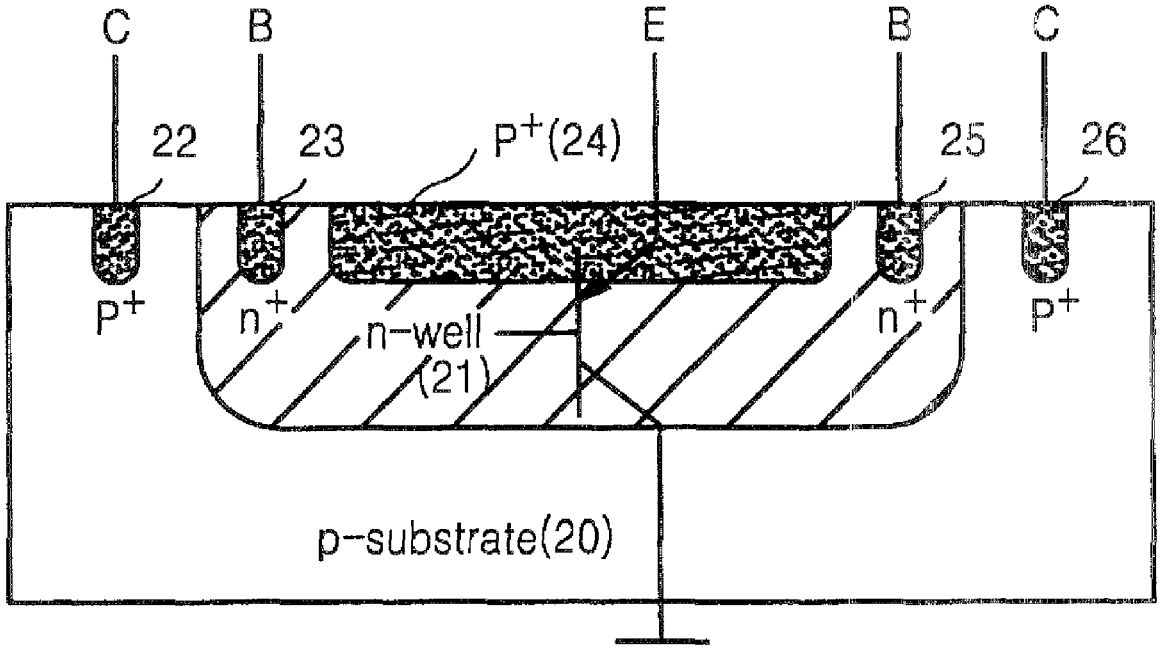
FIG. 2 (PRIOR ART)
Figure 3:
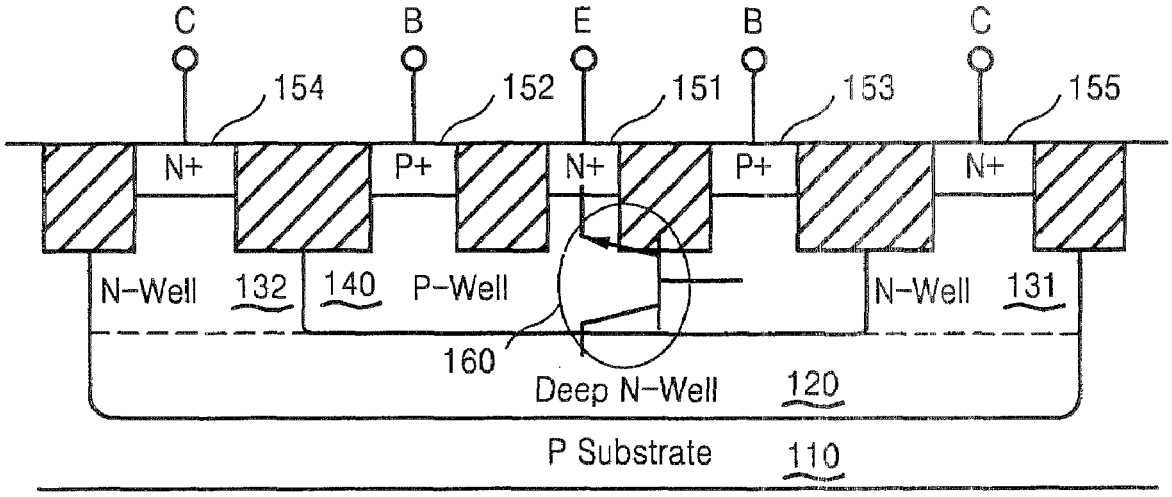
FIG. 3 is a cross-sectional view of a vertical NPN BJT implemented by a deep N-well CMOS process, according to an exemplary embodiment of the present invention.

FIG. 3 is a cross-sectional view of a vertical NPN bipolar junction transistor (BJT) implemented by a deep N-well complementary metal-oxide semiconductor (CMOS) process, according to an exemplary embodiment of the present invention. Referring to FIG. 3, a deep N-well 120 is formed on a P substrate 110. N-wells 131 and 132 and a P-well 140 are formed on the deep N-well 120. N+ or P+ ions are implanted or diffused into each of predetermined regions in the N-wells 131 and 132 and the P-well 140, thereby forming base contact regions 152 and 153, collector contact regions 154 and 155, and an emitter contact region 151. In details, an N+ region 151 in the P-well 140 forms an emitter, the P-well 140 and P+ contacts 152 and 153 form a base: and the deep N-well 120, the N-wells 131 and 132, and N+ regions 154 and 155 form a collector.

When the deep N-well CMOS process described above is used, a vertical NPN BJT denoted by reference numeral 160 can be implemented.

Figure 4:
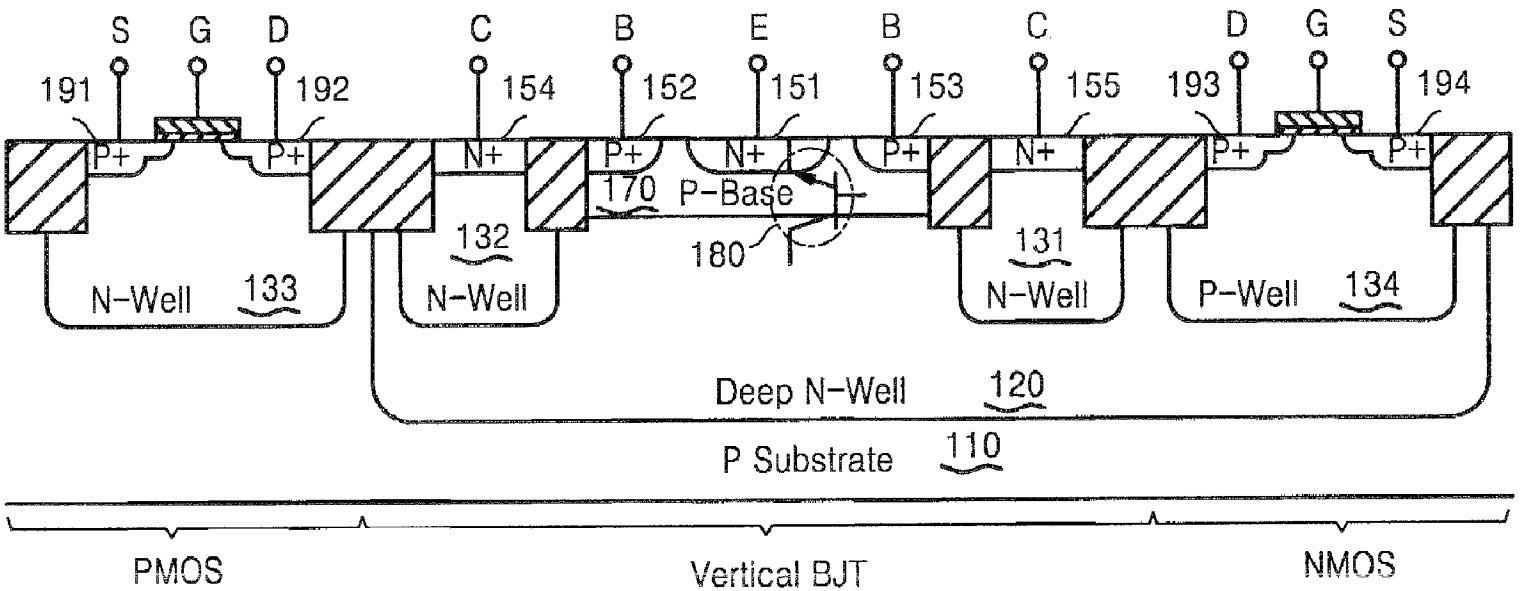
FIG. 4 is a cross-sectional view of a vertical NPN BJT implemented by a deep N-well CMOS process, according to an exemplary embodiment of the present invention.

FIG. 4 is a cross-sectional view of a vertical NPN BJT implemented by a deep N-well CMOS process, according to an exemplary embodiment of the present invention. Referring to FIG. 4, a P-base process is added to the deep N-well CMOS process illustrated in FIG. 3.

In addition, a positive-channel MOS (PMOS) transistor and a negative-channel MOS (NMOS) transistor, which are implemented by a deep N-well CMOS process, are further illustrated in FIG. 4. An N-well 133 forms a gate and P+ regions, that is, P+ ion implanted or diffused regions, 191 and 192 in the N-well 133 form a source and drain, thereby constructing a PMOS transistor. Meanwhile, a P-well 134 forms a gate and N+ regions 193 and 194 in the P-well 134 form a source and drain, respectively, thereby constructing an NMOS transistor. PMOS transistors and NMOS transistors, which are implemented by a deep N-well CMOS process, are widely known in the art. Thus, detailed descriptions thereof will be omitted.

When the P-base process is additionally performed, the N-wells 131 and 132 and a P-base 170 are formed on the deep N-well 120, as illustrated in FIG. 4, N+ or P+ ions are implanted or diffused into each of predetermined regions in the N-wells 131 and 132 and the P-base 170, thereby forming the base contact regions 152 and 153, the collector contact regions 154 and 155, and the emitter contact region 151. In detail, the N+ region 151 in the P-base 170 forms an emitter; the P-base 170 and the P+ contacts 152 and 153 form a base; and the deep N-well 120, the N-wells 131 and 132, and N+ regions 154 and 155 form a collector.

When the deep N-well CMOS process described above is used, a vertical NPN BJT denoted by reference numeral 180 can be implemented.

A current gain (β) of a BJT is largely influenced by a base width In other words, when the base width decreases, the current gain increases and has high characteristics. Since the P-well 140 is so thick in the vertical BJT 160 illustrated in FIG. 3, the current gain is low and has low characteristics. Since the P-base 170 is so thin in the vertical BJT 180 illustrated in FIG. 4, the current gain has higher characteristics than in the vertical BJT 160 illustrated in FIG. 3. That is, since the depth of the P-base 170 is less than that of the P-well 140, performance of the vertical BJT 180 illustrated in FIG. 4 is better than that of the vertical BJT 160 illustrated in FIG. 3.

According to an exemplary embodiment of the present invention, instead of a lateral or substrate BJT device, a vertical BJT implemented by a deep N-well CMOS process is used in a semiconductor circuit and, particularly, in a bandgap voltage reference circuit and a bandgap current reference circuit to improve the performance of semiconductor circuits requiring BJT operating characteristics.

Figure 5:
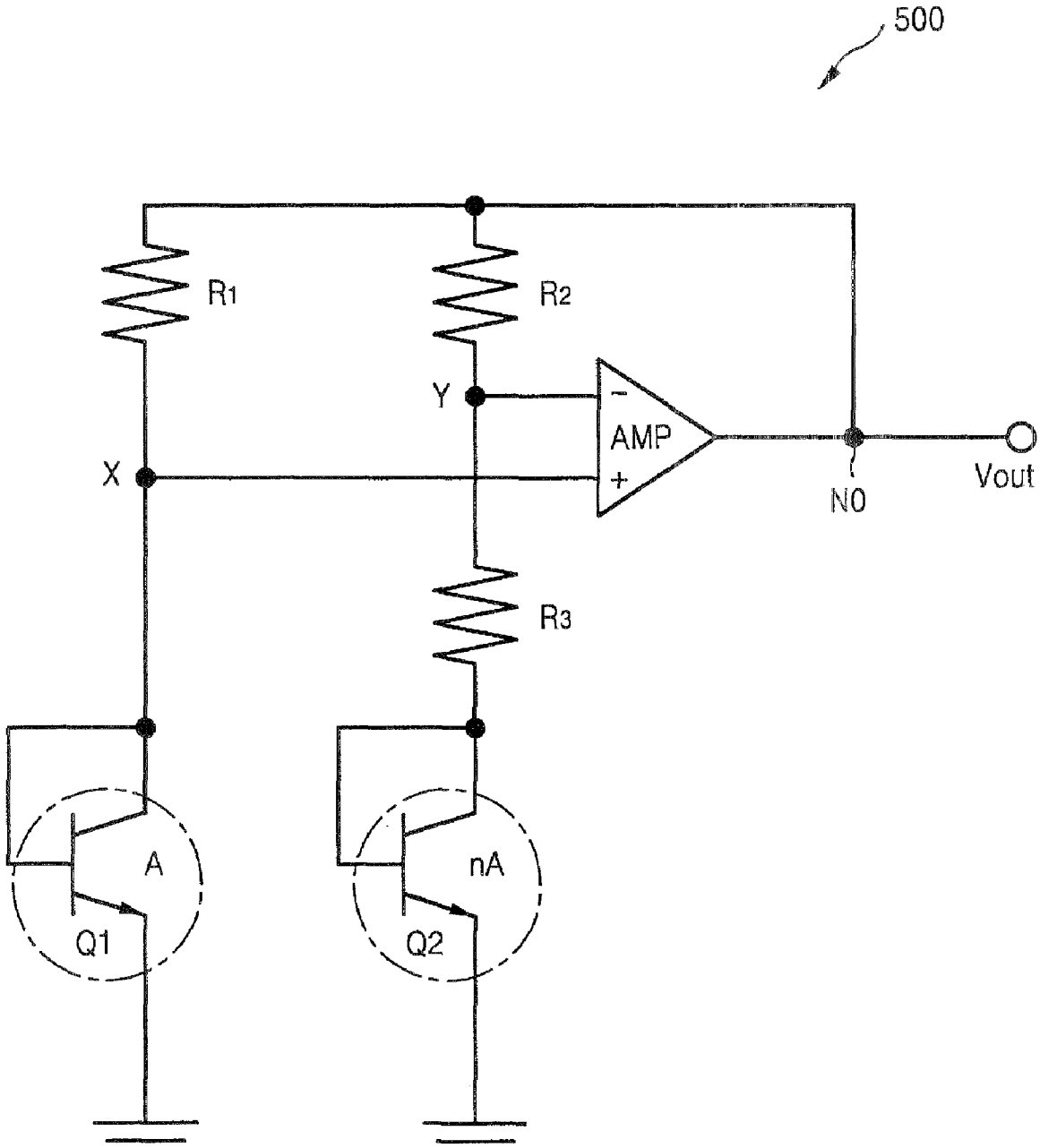
FIG. 5 is a diagram of a bandgap voltage reference circuit according to an exemplary embodiment of the present invention.

FIG. 5 is a diagram of a bandgap voltage reference circuit 500 according to an exemplary embodiment of the present invention. Referring to FIG. 5, the bandgap voltage reference circuit 500 includes a first transistor Q1, a second transistor Q2, an amplifier AMP, and first through third resistors $R_1$, $R_2$, and $R_3$. Each of the first and second transistors Q1 and Q2 is a vertical NPN BJT implemented by a deep N-well CMOS process.

The first resistor $R_1$ is connected between a positive input terminal X of the amplifier AMP and an output node NO and the second resistor $R_2$ is connected between a negative input terminal Y of the amplifier AMP and the output node N0. The first transistor Q1 is connected between the positive input terminal X of the amplifier AMP and ground. The third resistor $R_3$ and the second transistor Q2 are connected in series between the negative input terminal Y of the amplifier AMP and the ground. In each of the first and second transistors Q1 and Q2, a collector and a base are connected to each other.

The bandgap voltage reference circuit 500 having the above-described structure is a sort of voltage reference circuit that generates a predetermined reference voltage $V_{out}$, which is also called a bias voltage. The reference voltage $V_{out}$ is determined by Equation (1);

$$V_{out} = V_{BE2} + V_T \ln n\left(1 + \frac{R_2}{R_3}\right), \tag{1}$$

where $V_{BE2}$ is a base-emitter voltage of the second transistor Q2, $V_T$ is a thermal voltage, and "n" is a ratio of an emitter size of the second transistor Q2 to an emitter size of the first transistor Q1.

As is known from Equation (1), the reference voltage $V_{out}$ is calculated by adding the base-emitter voltage of the second transistor Q2 to a value obtained by multiplying the thermal voltage $V_T$ by a predetermined factor $$\ln n\left(1+\frac{R_2}{R_3}\right).$$

Here, the predetermined factor is determined by values of n, $R_2$, and $R_3$. Accordingly, a desired reference voltage $V_{out}$ can be obtained by adjusting the values of n, $R_2$, and $R_3$.

The reference voltage $V_{out}$ generated by the bandgap voltage reference circuit 500 has an almost constant DC value regardless of temperature. Accordingly, the reference voltage $V_{out}$ generated by the bandgap voltage reference circuit 500 may be applied to a circuit needing a constant reference voltage that is, a constant bias voltage.

Figure 6:
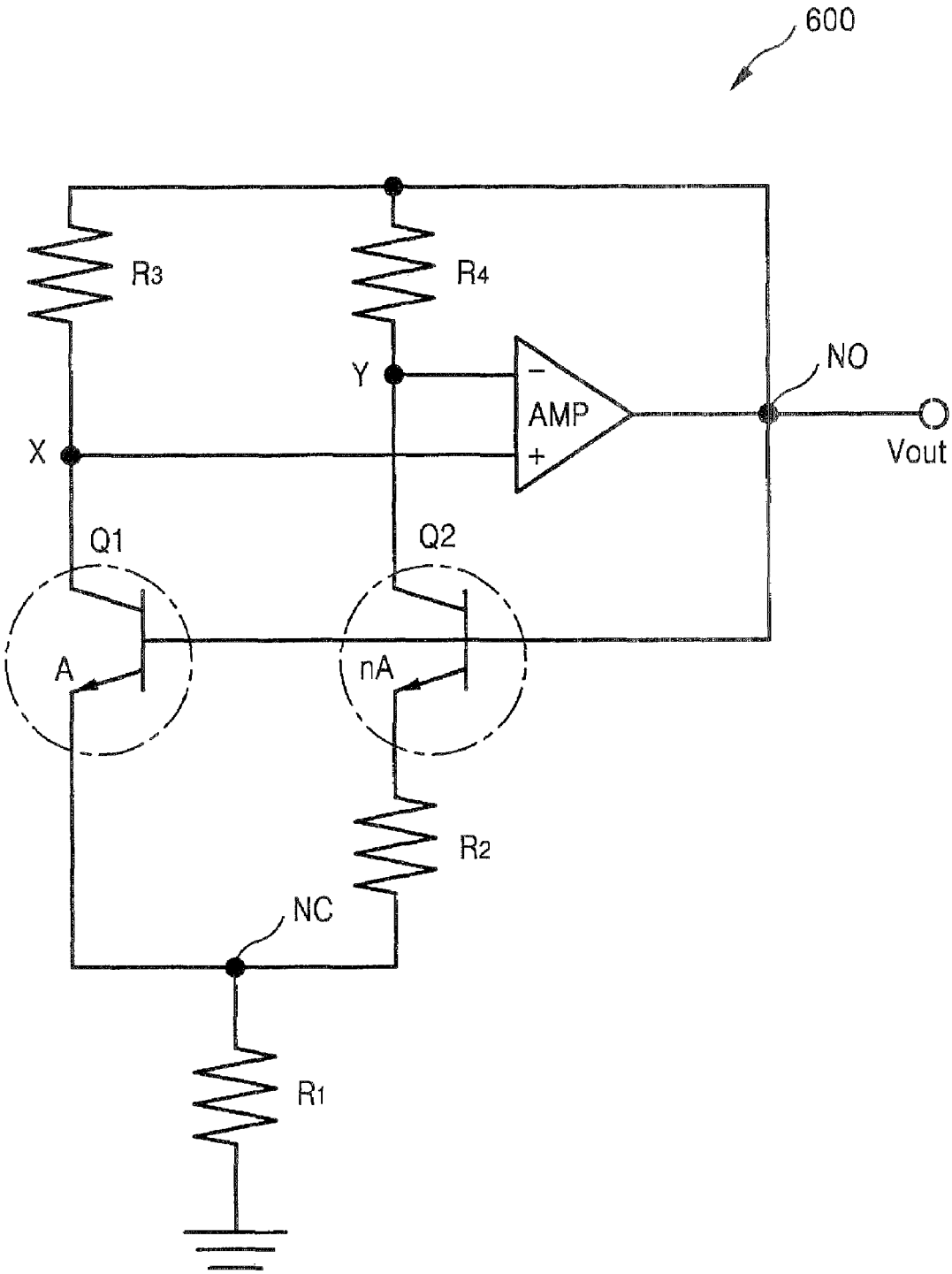
FIG. 6 is a diagram of a bandgap voltage reference circuit according to an exemplary embodiment of the present invention.

FIG. 6 is a diagram of a bandgap voltage reference circuit 600 according to an exemplary embodiment of the present invention. Referring to FIG. 6, the bandgap voltage reference circuit 600 includes a first transistor Q1, a second transistor Q2, an amplifier AMP, and first through fourth resistors $R_1$, $R_2$, $R_3$, and $R_4$. Each of the first and second transistors Q1 and Q2 is a vertical NPN BJT implemented by a deep N-well CMOS process.

The third resistor $R_3$ is connected between a positive input terminal X of the amplifier AMP and an output node NO and the fourth resistor $R_4$ is connected between a negative input terminal Y of the amplifier AMP and the output node N0. The first transistor Q1 is connected between the positive input terminal X of the amplifier AMP and a common node NC. The second transistor Q2 and the second resistor $R_2$ are connected in series between the negative input terminal Y of the amplifier AMP and the common node NC. The first resistor $R_1$ is connected between the common node NC and ground. Bases of the first and second transistors Q1 and Q2 are connected to the output node N0.

The bandgap voltage reference circuit 600 having the above-described structure is also a sort of voltage reference circuit that generates a predetermined reference voltage $V_{out}$ (which is also called a bias voltage). The reference voltage $V_{out}$ is determined by Equation (2):

$$V_{out} = V_{BE2} + 2V_T\left(\frac{R_1}{R_2}\right)\ln n, \tag{2}$$

where $V_{BE2}$ is a base-emitter voltage of the second transistor Q2, $V_T$ is a thermal voltage and "n" is a ratio of an emitter size of the second transistor Q2 to an emitter size of the first transistor Q1.

As is known from Equation (2), the reference voltage $V_{out}$ is calculated by adding the base-emitter voltage of the second transistor Q2 to a value obtained by multiplying the thermal voltage $V_T$ by a predetermined factor $$2\left(\frac{R_1}{R_2}\right)\ln n$$

The predetermined factor is determined by values of n, $R_1$, and $R_2$. Accordingly, a desired reference voltage $V_{out}$ can be obtained by adjusting the values of n, $R_1$, and $R_2$.

The reference voltage $V_{out}$ generated by the bandgap voltage reference circuit 600 has an almost constant DC value regardless of temperature. Accordingly, the reference voltage $V_{out}$ generated by the bandgap voltage reference circuit 600 may be applied to a circuit needing a constant reference voltage, for example, a circuit that requires a constant bias voltage.

As illustrated in FIGS. 5 and 6, when a bandgap voltage reference circuit is implemented using a vertical BJT implemented by a deep N-well CMOS process, it has better current drivability than a bandgap voltage reference circuit using a conventional lateral or substrate BJT. In addition, a bandgap voltage reference circuit with improved reproducibility, uniformity, and device matching can be provided.

Figure 7:
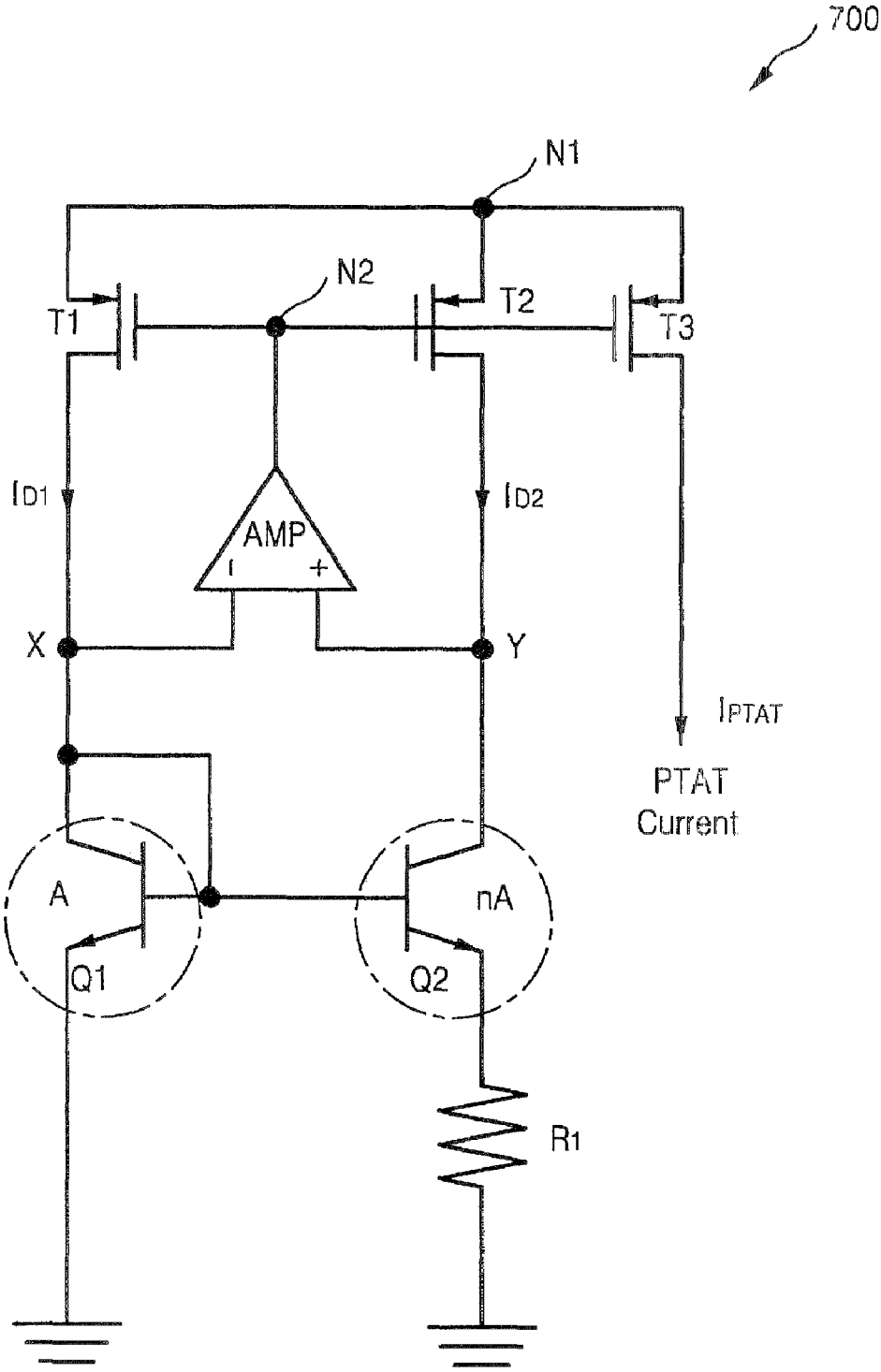
FIG. 7 is a diagram of a current reference circuit according to an exemplary embodiment of the present invention.

FIG. 7 is a diagram of a current reference circuit 700 according to an embodiment of the present invention. Referring to FIG. 7, the current reference circuit 700 includes a first BJT Q1, a second BJT Q2, an amplifier AMP, first through third MOS transistors T1, T2, and T3, and a resistor $R_1$. Each of the first and second BJTs Q1 and Q2 is a vertical NPN BJT implemented by a deep N-well CMOS process.

The first MOS transistor T1 is connected between a negative input terminal X of the amplifier AMP and a first node N1 and the second MOS transistor T2 is connected between a positive input terminal Y of the amplifier AMP and a second node N2. The first BJT Q1 is connected between the negative input terminal X of the amplifier AMP and ground. The second BJT Q2 and the resistor $R_1$ are connected in series between the positive input terminal Y of the amplifier AMP and ground. A collector and a base of the first BJT Q1 and a base of the second BJT Q2 are commonly connected to one another.

Gates of the first through third MOS transistors T1, T2 and T3 are commonly connected to the output node N2 of the amplifier AMP.

The current reference circuit 700 having the above-described structure outputs a DC reference current $I_{PTAT}$, which is also called a bias current, proportional to absolute temperature through the third MOS transistor T3. Accordingly, the current reference circuit 700 is generally proportional to the absolute temperature (PTAT) current reference circuit.

In the current reference circuit 700, collector currents $I_{D1}$ and $I_{D2}$ of the respective first and second BJTs Q1 and Q2 have a relationship defined as Equation (3):

$$I_{D1} = I_{D2} = \frac{V_T \ln n}{R_1}, \tag{3}$$

where $V_T$ is a thermal voltage and "n" is a ratio of an emitter size of the second BJT Q2 to an emitter size of the first BJT Q1.

The reference current $I_{PTAT}$ is determined by the collector currents $I_{D1}$ and $I_{D2}$ of the respective first and second BJTs Q1 and Q2. Accordingly, the reference current $I_{PTAT}$ is calculated by multiplying the thermal voltage $V_T$ by a predetermined factor $$\frac{\ln n}{R_1}.$$

The predetermined factor is determined by the values of "n" and $R_1$. Accordingly, a desired reference current $I_{PTAT}$ can be obtained by adjusting the value of "n" and $R_1$.

The reference current $I_{PTAT}$ generated by the current reference circuit 700 has a value proportional to temperature. The current reference circuit 700 can be thought of as a kind of current source. The reference current $I_{PTAT}$ generated by the current reference circuit 700 may be applied to a circuit needing a constant reference current, that is, a bias current, through a current mirror circuit.

As illustrated in FIG. 7, when a current reference circuit is implemented using a vertical BJT implemented by a deep N-well CMOS process, it has better current drivability than a current reference circuit using a conventional lateral or substrate BJT. In addition, a current reference circuit with improved reproducibility, uniformity, and device matching can be provided.

A vertical BJT device manufactured using a deep N-well CMOS process has improved dynamic range of current and current drivability. In addition, a vertical BJT device is not sensitive to changes in process variables, for example, temperature, pressure, and voltage, thereby improving reproducibility, uniformity, and device matching.

As described above, according to exemplary embodiments of the present invention, instead of a lateral NPN/PNP device or substrate NPN/PNP device manufactured using a CMOS process, a vertical BJT device manufactured using a deep N-well CMOS process is used in a voltage reference circuit and a current reference circuit, thereby providing circuits having better reproducibility, uniformity, and device matching than circuits that use a lateral NPN/PNP device or substrate NPN/PNP device manufactured using a CMOS process.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A voltage reference circuit for generating a constant reference voltage comprising:

an amplifier element having a positive input terminal and a negative input terminal;

a first transistor electrically connected to the positive input terminal; and a second transistor electrically connected to the negative input terminal, wherein each of the first and second transistors is a vertical bipolar junction transistor implemented by a deep N-well complementary metal-oxide semiconductor (CMOS) process, and the reference voltage is calculated by adding a base-emitter voltage of one of the first and second transistors to a value obtained by multiplying a thermal voltage by a predetermined factor, and wherein bases of the respective first and second transistors are commonly connected to an output node of the amplifier element, and the second transistor is connected to a node having a predetermined voltage through a first resistor element.

2. The voltage reference circuit of claim 1, further comprising:

a second resistor element connected between the positive input terminal and an output node of the amplifier element: and a third resistor element connected between the negative input terminal and the output node of the amplifier element.

3. The voltage reference circuit of claim 2 wherein the predetermined factor is a function of a resistance value of the first resistor element, a resistance value of the second resistor element and a ratio of an emitter size of the second transistor to an emitter size of the first transistor.

4. The voltage reference circuit of claim 1, wherein the deep N-well CMOS process comprises a P-base process.

* * * * *